US005443410A

United States Patent [19]

Ko

[11] Patent Number: 5,443,410

[45] Date of Patent: Aug. 22, 1995

[54] GETTER FIXING DEVICE FOR A CATHODE RAY TUBE

[75] Inventor: Byoung D. Ko, Chilgok, Rep. of Korea

[73] Assignee: Goldstar Co., Ltd., Seoul, Rep. of Korea

[21] Appl. No.: 224,974

[22] Filed: Apr. 8, 1994

[30] Foreign Application Priority Data

Jul. 24, 1993 [KR] Rep. of Korea ..... 1993-14110

[51] Int. Cl.[6] ..... H01J 9/39

[52] U.S. Cl. ..... 445/73; 313/560; 313/561; 445/55

[58] Field of Search ..... 445/31, 55, 62, 70, 445/73; 313/481, 560, 561, 1

[56] References Cited

U.S. PATENT DOCUMENTS

| | | | |
|---|---|---|---|
| 2,855,534 | 10/1958 | Moubis | 313/561 |
| 3,432,712 | 3/1969 | Benda | 313/481 |
| 4,721,882 | 1/1988 | Van Daelen | 313/481 |

FOREIGN PATENT DOCUMENTS

| | | | |
|---|---|---|---|
| 1169730 | 11/1969 | United Kingdom | 313/481 |

*Primary Examiner*—Mark Rosenbaum
*Assistant Examiner*—Jeffrey T. Knapp

[57] ABSTRACT

A getter fixing device for a cathode ray tube includes one or more folded strips. These strips are welded to a getter cover or united in one body with the getter cover or a support member. The device also includes two inclined wing portions that direct diffusion of the getter material. Such a getter device allows attachment of various getter forms, and parts needed for this device may be standardized.

6 Claims, 5 Drawing Sheets

GETTER FIXING DEVICE FOR A CATHODE RAY TUBE

BACKGROUND OF THE INVENTION

The present invention relates to a getter fixing device for a cathode ray tube (CRT), and more particularly to a getter fixing device which includes strips positioned outside a support member to attach a getter cover, resulting in fixing various forms of getter ring.

Generally in a CRT C as shown in FIG. 1, a shadow mask 1 is attached to the inner surface of a panel 2, a funnel 3 is joined to the rear of the panel 2, and a getter for improving the degree of vacuum of the CRT C is attached to the funnel 3.

With reference to FIGS. 2(*a*) and 2(*b*), the getter assembly 5 comprises a getter ring 6, a support member 7 for fixing the getter ring 6 by welding, and a getter cover 8 which is attached to the support member 7 and directs the diffusion of getter material 6*a*. The support member 7 and the getter cover 8 are conventionally made of heat resisting stainless steel, and the getter material 6*a* which is composed of Ba, A1 and Ni mixed in the usual ratio, is pressed in the inner surface of the getter ring 6. A R.F. coil 10 is used for heating the getter ring 6.

The getter material 6*a*, usually barium, in the getter ring 6 is released into the interior of the CRT C when the getter ring 6 of the getter assembly 5 is heated to about 1150° C. by R. F. heating coil after the tube's atmosphere is evacuated during tube manufacture. The evaporated barium absorbs various residual gases in the CRT C by ionization phenomenon in aging process so that the internal degree of vacuum of the CRT C is maintained at about $10^{-7}$ Torr.

The getter cover 8 prevents the deposition of evaporated barium in the shadow mask 1 since the deposition of barium in the shadow mask 1 is not uniform.

The shadow mask 1 is subject to thermal expansion by heat over a temperature range of about 80° C. generated by the collision of beam emitted from an electron gun 4. The getter assembly 5 must include the getter cover 8 to avoid deposition of getter material 6*a* in the shadow mask 1 since the deviation of a coefficient of thermal expansion according to the degree of the deposition (in case of such unequal deposition), results in a doming phenomenon which deteriorates screen characteristic and decreases brightness.

However, the conventional getter fixing device has a problem in that the plan for the getter cover 8, the support member 7 and the like must be changed according to the form of the getter ring 6. That is, FIGS, 2(*a*) and 2(*b*) illustrate the getter ring 6 in which a central attaching hole 6*b* is formed, and the getter cover 8 having a central sunk weld portion 8*a* formed by drawing, is affixed through the attaching hole 6*b* to the support member 7 by welding. However, it is well known in the art that, in addition to the shape illustrated in FIGS, 2(*a*) and 2(*b*), the getter ring 6 can be formed in various other shapes, for example, as a round plate shape as shown in cannot be directly affixed to the support member 7 because of the getter ring 6, resulting in plan changes of the constituent parts and, more particularly, limitation of standardization of the getter assembly 5 except the getter ring 6.

SUMMARY OF THE INVENTION

Accordingly, it is an object of the present invention to provide a getter fixing device for a CRT which includes one or more strips to fix a getter cover directly on the upper portion of the strips, resulting in various forms of getter ring fixing device irrespective of the forms of the getter ring.

BRIEF DESCRIPTION OF THE DRAWINGS

FIG, 1 is a partial cross-sectional view of a conventional cathode ray tube;

FIGS, 2(*a*) and 2(*b*) are plan and front views of a conventional getter fixing device;

Figure 5:
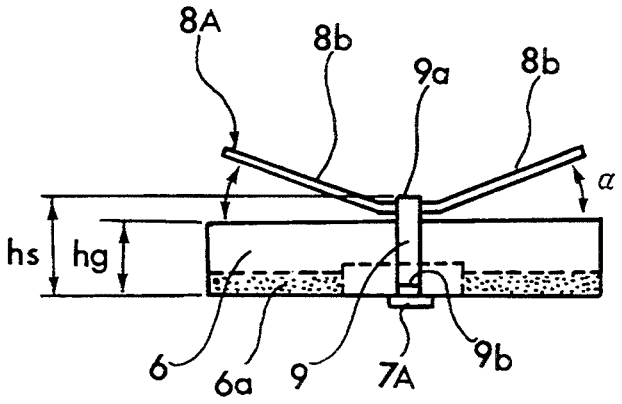

FIGS, 3(*a*) and 3(*b*) are another plan and front views of a conventional getter fixing device;

FIGS, 4(*a*) and 4(*b*) are plax and front views of a getter fixing device according to the present invention;

FIG. 5 is a side view of a getter fixing device according to the present invention.

DETAILED DESCRIPTION OF THE INVENTION

In order to achieve aforementioned object, preferred embodiments of the present invention are described in detail by accompanying drawings using the same symbols for parts or members which are the same with the prior art.

Figure 4A:
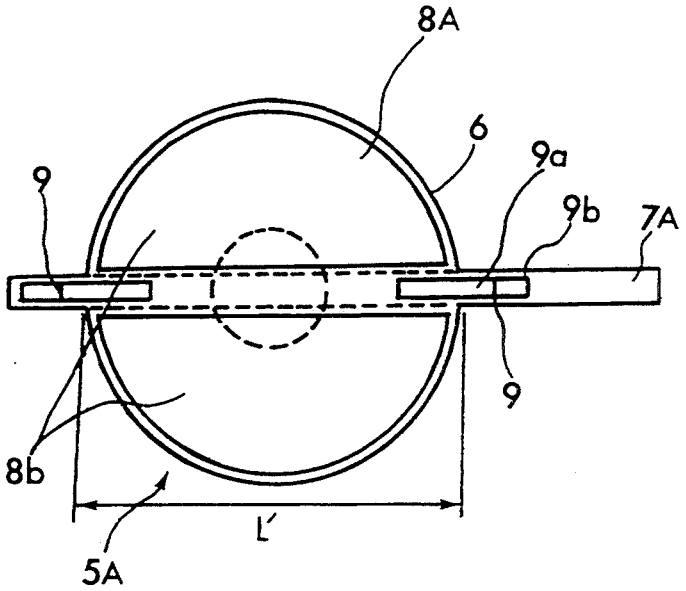
Figure 4B:
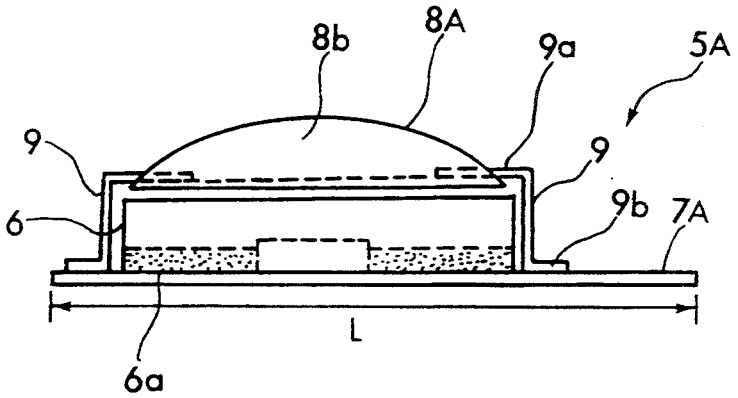

As shown in FIGS. 4(*a*) and 4(*b*), the getter assembly 5A according to the present invention comprises a support member 7A for attaching the getter ring 6, a getter cover 8A for directing the diffusion of the getter material 6*a* of the getter ring 6, and with strips 9 positioned outside the getter ring 6 for connecting the support member 7A with the getter cover 8A.

In the embodiment of FIGS. 4(*a*) and 4(*b*), the area of the getter cover 8A is preferably set within the range of 80—120% of that of the getter ring 6*a* and as shown in FIG. 5, both wing portions 8*b* of the getter cover 8A can direct diffusion of the getter material 6*a* by means of a folded angle $\alpha$ to the getter ring 6. Though the length L of the support member 7A is longer than the length L' of the getter ring 6 in FIGS. 4(*a*) and 4(*b*), the length L can be changed without departing from the scope of the present invention.

The strips 9 can be welded to the support member 7A and the getter cover 8A by means of folded attaching portions 9*a* and 9*b* positioned at both upper and lower extreme parts as shown in FIGS. 4(*a*) and 4(*b*), or can be united with the support member 7A or the getter cover 8A in one body according to requirement. In addition, the support member 7A has protrusions at both sides of the getter 6 to attach the getter ring 6 firmly. In any case, the height hs of the strips 9 is substantially greater than the height hg of the getter ring 6.

Figure 1:
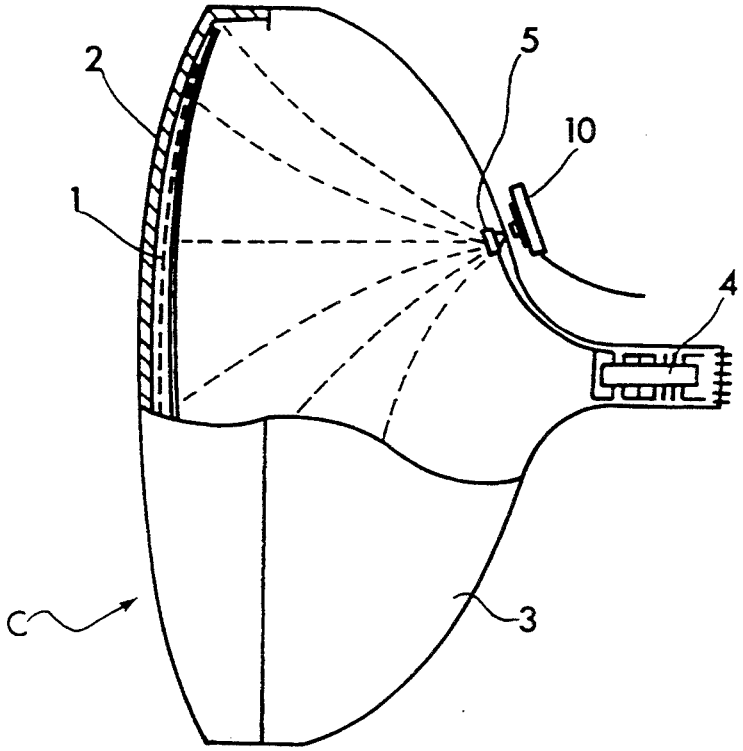
FIG. 1 PRIOR ART
Figure 2A:
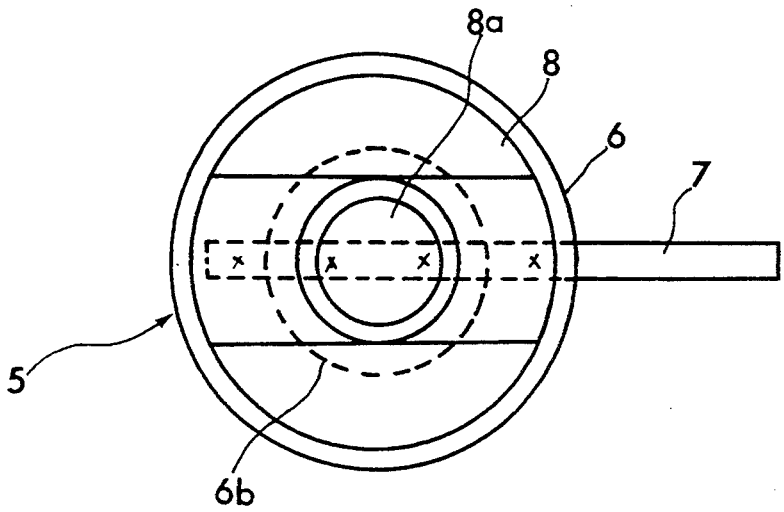
FIG. 2(a) PRIOR ART
Figure 2B:
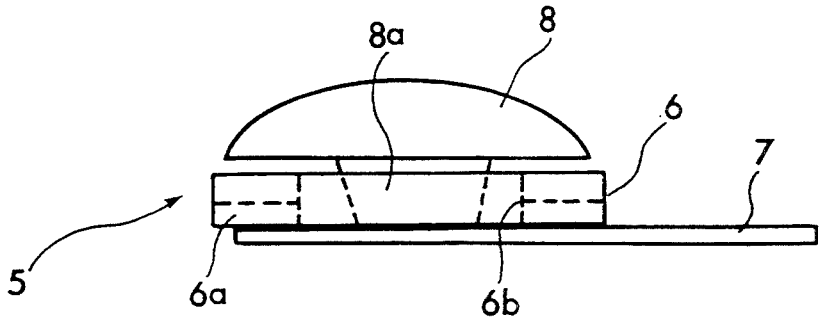
FIG. 2(b) PRIOR ART
Figure 3A:
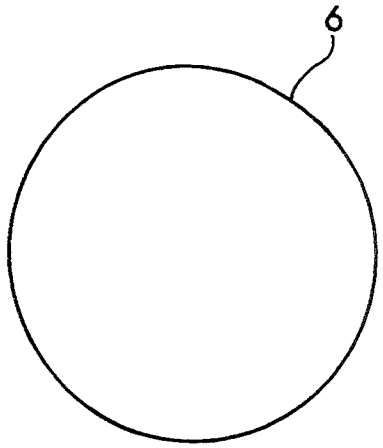
FIG. 3(a) PRIOR ART
Figure 3B:
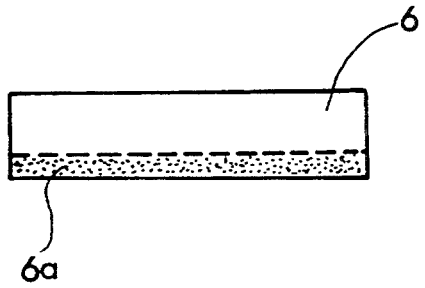
FIG. 3(b) PRIOR ART

The getter fixing device according to the present invention connects the support member 7A and the getter cover 8A irrespective of the forms of the getter ring 6 since the upper attaching portion 9*a* of the strips 9 is welded to both central side portions of the wing portions 8*b* of the getter cover 8A, and the lower attaching portion 9*b* of the strips 9 is welded to the support member Because the distance between the support member 7A and the getter cover 8A, that is, the height hs of the strips 9 is greater than the height hg of various forms of the getter ring 6 in addition to getter ring 6 illustrated in FIGS. 2(*a*) and 2(*b*) or FIGS. 3(*a*) and 3(*b*), insertion and welding onto the support member 7A is very easily accomplished.

Accordingly, the present invention can fix various forms of the getter ring 6 and plan changes of the constituent parts according to the forms of the getter ring 6 can be omitted, so that cost is reduced, productivity is increased, and standardization of constituent parts is achieved.

While specific embodiments of the invention have been illustrated and described wherein, it should be realized that modifications and changes will occur to those skilled in the art. It is therefore to be understood that the appended claims are intended to cover all modifications and changes as fall within the true spirit and scope of the invention.

What is claimed is:

1. A getter fixing device for a cathode ray tube comprising:

a getter ring including getter material;

a support member for attaching said getter ring., said support member having protrusions at two sides of the getter ring;

a getter cover including a central portion with two side portions and two wing portions attached to the central portion, each of said two wing portions inclined at a prescribed angle away from the getter ring so as to direct diffusion of the getter material;

and a single or a plurality of means, each positioned outside said getter ring for connecting a respective one of said protrusions of said support member with said getter cover.

2. A getter fixing device for a cathode ray tube according to claim 1 wherein said means for connecting are united with said support member or said getter cover in one body,

3. The getter fixing device for a cathode ray tube according to claim 1, wherein said means for connecting is a strip.

4. A getter fixing device for a cathode ray tube according to claim 1 wherein said means are strips,

5. The getter fixing device according to claim 1, wherein a height of said means for connecting exceeds the height of said getter ring with getter material.

6. The getter fixing device for a cathode ray tube according to claim 1, wherein the area of said getter cover is 80—120% of the area of the getter ring.

* * * * *